US005669156A

United States Patent [19]

Vejchoda

[11] Patent Number: 5,669,156

[45] Date of Patent: Sep. 23, 1997

[54] CAN END CURING SYSTEM WITH MAGNETIC FANNING AND BELT CONVEYING

[75] Inventor: Miroslav W. Vejchoda, Downers Grove, Ill.

[73] Assignee: Fleetwood Systems, Inc., Romeoville, Ill.

[21] Appl. No.: 697,670

[22] Filed: Aug. 28, 1996

[51] Int. Cl.[6] ..... F26B 3/34

[52] U.S. Cl. ..... 34/248; 34/105; 34/203; 34/438; 34/216; 198/619; 198/381

[58] Field of Search ..... 34/105, 203, 248, 34/429, 438, 216, 217, 236; 198/459.1, 619, 381

[56] References Cited

U.S. PATENT DOCUMENTS

| | | | |
|---|---|---|---|
| 4,364,466 | 12/1982 | Mojden | 198/459 |
| 5,318,166 | 6/1994 | Mojden et al. | 198/493 |
| 5,450,679 | 9/1995 | Mojden et al. | 34/105 |

*Primary Examiner*—Henry A. Bennett
*Assistant Examiner*—Dinnatia Doster
*Attorney, Agent, or Firm*—Trexler, Bushnell, Giangiorgi & Blackstone, Ltd.

[57] ABSTRACT

An article separating and drying system which receives container ends from an infeed station, separates and dries the container ends and the compound applied thereto in a separating and drying station, and passes the articles to an outfeed station. The article separating and drying system includes a magnetic separating assembly which imposes a magnetic field on the container ends passing thereby for similarly magnetizing the container ends causing neighboring ends to repel one another. The magnetic repulsion of neighboring ends produces gaps between the neighboring ends as they move through the separating and drying station. A conveying device is provided to controllably move the container ends through the separating and drying station. An air distribution assembly is provided to deliver air to said separating and drying station and drive the air through the gap between neighboring container ends thereby contacting the liner compound applied to the container ends and removing moisture therefrom. Moisture removed from the container ends may be collected in a moisture collection station. Ends are positioned in a facewise stacked condition as they move into the infeed station.

16 Claims, 3 Drawing Sheets

CAN END CURING SYSTEM WITH MAGNETIC FANNING AND BELT CONVEYING

The system of the present invention may find utility in other applications. The disclosure provided herein will make particular reference to the handling of container ends during fabrication operations as well as subsequent use of such container ends during packaging operations. In the manufacture and filling of containers, for example beverage containers, vast numbers of container ends are required. Present fabrication and filling operations require handling such large quantities of container ends at a high rate of speed in a generally continuous process. The fabrication or filling facility may have several lanes of can ends streaming to or from various processing steps. Throughout the description of the present invention, groups of container ends generally will be referred to as "sticks of ends" or "groups of ends". Additionally, generally continuous flows of ends will be referred to as a "stream of ends".

By way of background, many fabrication steps may be involved in the fabrication of container ends including stamping a blank end, conversion by which the stamped blank end is formed with a lip or cuff, and, perhaps, application of a pull tap. Additionally, a suitable liner material, compound, or coating may be required depending on the type of product which is to be retained in the container. The liner compound provides a barrier layer between the contents of the container and the container material. Such liner compound is required in the food processing industry. If a liner compound or coating is used a repair may have to be effected to seal any nicks or scrapes which may occur during the fabrication process. A final step in the fabrication process may involve placing a predetermined number of container ends in a suitable bag or tray.

The liner compound may be applied in a powdered or liquid spray form, and often requires a period of heat curing prior to additional processing of the container end. In the prior art, it has been practice to deliver container ends, following the coating or spraying operation, to a generally large thermal oven. In general terms, the container ends are conveyed at a relatively low speed through a relatively long flat oven. The speed of the conveyor through the oven, the overall length of the oven and the temperature inside the oven are all selected to assure proper curing of the liner compound while the container ends move therethrough. Numerous ovens and processing lines are used to maintain a desired rate of container end processing.

As an additional matter, in the past, quick drying, solvent-based compounds, formulated with volatile hydrocarbon dilutant or solvent were widely used. However, solvent vapors generated upon curing of these compounds resulted in undesirable atmospheric pollution. In response, water-based compounds had been developed and these products produce only moisture or water vapor as the compound cures. The water-based compounds have the disadvantage, however, of requiring comparatively long drying times, on the order of 90 seconds or more. Existing container end handling equipment is arranged to stack the ends immediately after application of the compound or after oven curing. While oven curing may remove a large portion of the moisture from the compound, additional moisture may continue to evolve after the heated curing process. The facewise stacking of the container ends results in confining the escaping moisture and prolonging the drying time, even after using an oven.

Several devices have been provided in the prior art in order to facilitate curing of materials applied to container ends. In particular, two patents, U.S. Pat. No. 5,450,679 issued Sep. 19, 1995, to Mojden and Vejchoda and U.S. Pat. No. 4,364,466 issued Dec. 21, 1982, to Mojden. Both of these patents are assigned to the Assignee of the present invention. In Mojden '679, a magnetic wheel is positioned inside of an oven. The magnetic wheel receives container ends having a liner compound on one surface thereof. The container ends are carded by the magnetic wheel through a path of more than 180° whereupon they are removed from the magnetic wheel and integrated back into a stream of container ends. While in the oven, the liner compound is cured. Essentially the wheel positioned in the oven provides a lengthened path in a relatively small area. One problem encountered in this type of drying method is the large mass of the wheel acting as a heat sink and potentially affecting the curing of the liner compound and the container end material.

Mojden '466 provides a device which mechanically spaces apart container ends for drying. The container ends pass through a conventional forced-air drying oven to pass a heated air stream between the spaced container ends. It can be seen that the device of Mojden '466 requires the mechanical engagement of the container ends between two opposed conveyor belts which are spaced in a predetermined distance in order to grip the container edges. As such, the device in Mojden '466 requires positive gripping of the container ends in order to space the ends apart and transport them through the system.

OBJECTS AND SUMMARY

A general object satisfied by the present invention is to provide an article separating and drying system which separates articles and moves air against the articles to cause the air to flow between the separated articles and remove moisture from the articles.

Another object satisfied by the present invention is to provide an article separating and drying system which operates within a small space so as to minimize the facility space required in order to remove moisture from articles processed thereby.

Still another object satisfied by the present invention is to provide a container end separator and drying system which separates container ends positioned in a facewise stacked condition and forces air between the separated container ends.

Still a further object of the present invention is to provide a container end separating and drying system which employs magnetic bodies to separate the container ends thereby minimizing the contact with the container ends and the compound applied thereto in order to prevent further damage to the surface to which the compound is applied.

Briefly, and in accordance with the foregoing, the present invention envisions an article separating and drying system which receives container ends from an infeed station, separates and dries the container ends and the compound applied thereto in a separating and drying station, and passes the articles to an outfeed station. The article separating and drying system includes a magnetic separating assembly which imposes a magnetic field on the container ends passing thereby for similarly magnetizing the container ends causing neighboring ends to repel one another. The magnetic repulsion of neighboring ends produces gaps between the neighboring ends as they move through the separating and drying station. A conveying device is provided to controllably move the container ends through the separating and drying station. An air distribution assembly is provided to deliver air to said separating and drying station and drive the air through the gap between neighboring container ends thereby contacting the liner compound applied to the container ends and removing moisture therefrom. Moisture removed from the container ends may be collected in a moisture collection station. Ends are positioned in a facewise stacked condition as they move into the infeed station.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
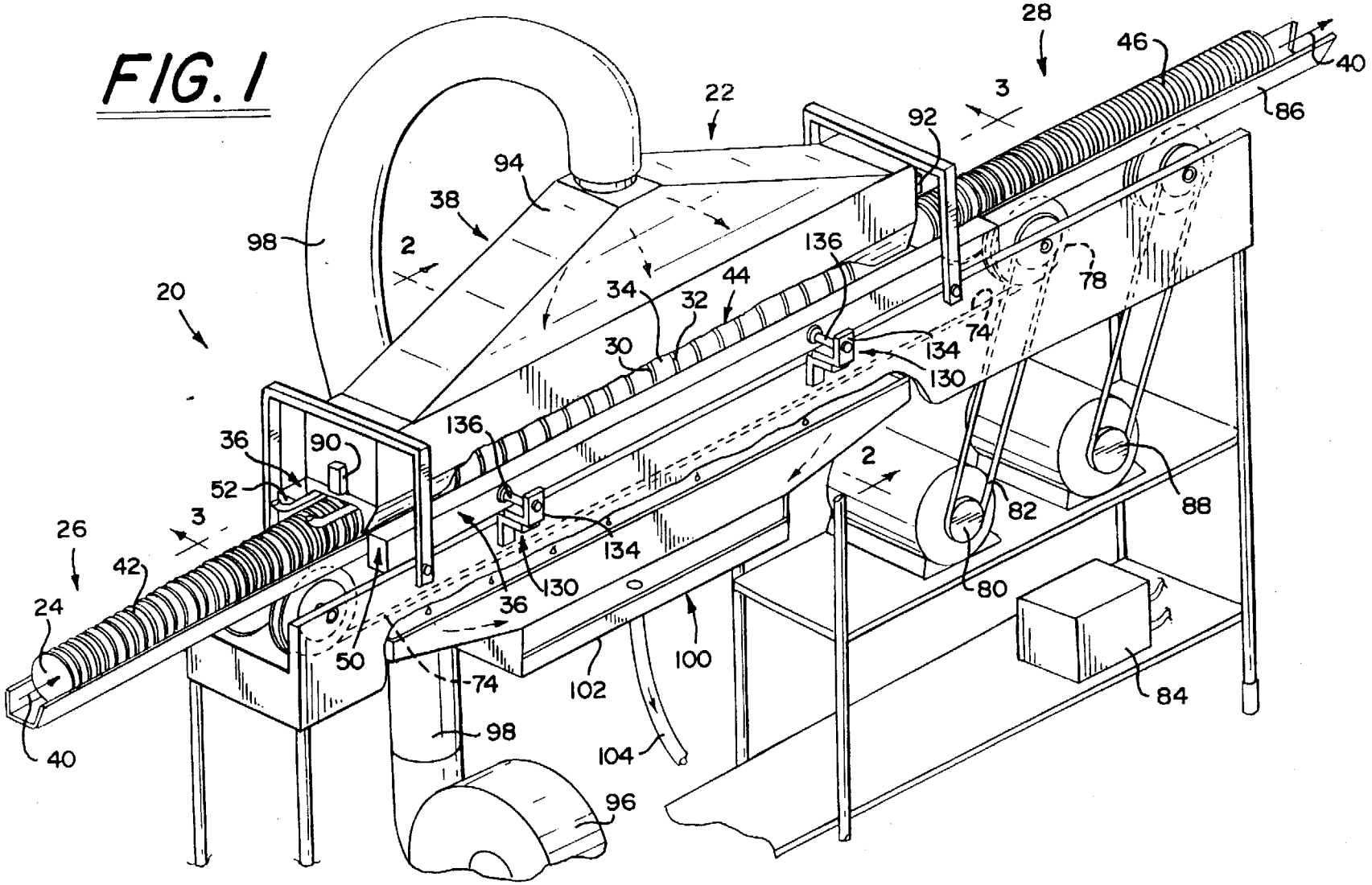
FIG. 1 is a partial fragmentary, perspective view of a separating and drying system of the present invention showing an infeed station connected to a separating and drying station which in turn is connected to an outfeed station for handling a series of container ends flowing through a common path of travel therethrough.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

An article separating and drying system 20 as shown in FIG. 1. The separating and drying system 20 includes a separating and drying station 22 which receives articles, shown herein as container ends 24, from an infeed station 26 and delivers container ends to an outfeed station 28. As the container ends 24 pass through the separating and drying station 22, they become spaced apart such that neighboring container ends 30, 32 define a gap 34 therebetween. The container ends are spaced apart by a magnetic assembly 36 which will be described in greater detail hereinbelow. An air distribution assembly 38 delivers air to the separated container ends thereby driving air through the gaps 34 between the neighboring container ends 30, 32 to drive off moisture from the container ends.

In the way of background, the separating and drying system of the present invention receives container ends at the infeed station 26 from an operation which applies liner compound to a surface of the container end or from a curing oven in which the compound has been primarily cured. The separating and drying system may be used as an initial drying stage or as a secondary drying stage. For example, if the ends are coming from a curing oven, the separating and drying system 20 may be used as a secondary or final curing stage. Similarly, if the ends are presented to the separating and drying system 20 from a liner application operation, the system will act as the primary curing step.

The article separating and drying system 20 provides a way to pass air over the surfaces having compound material thereon while maintaining a generally continuous stream of articles along a common path of travel 40. An infeed stream of articles 42 enters the separating and drying station 22 whereupon the articles become a separated stream 44 of articles. The separated stream of articles 44, upon leaving the separating and drying station 22 becomes an outfeed stream of articles 46. In both the infeed and outfeed streams of articles 42, 46 the articles, in the present case container ends, are positioned in abutting arrangement. More specifically, the container ends or can ends shown in the illustrated embodiment shows the container ends being positioned in a nested facewise stacked orientation. The orientation is maintained in the separated stream 44, however, the articles 30, 32 are separated to provide a gap 34 therebetween.

Figure 2:
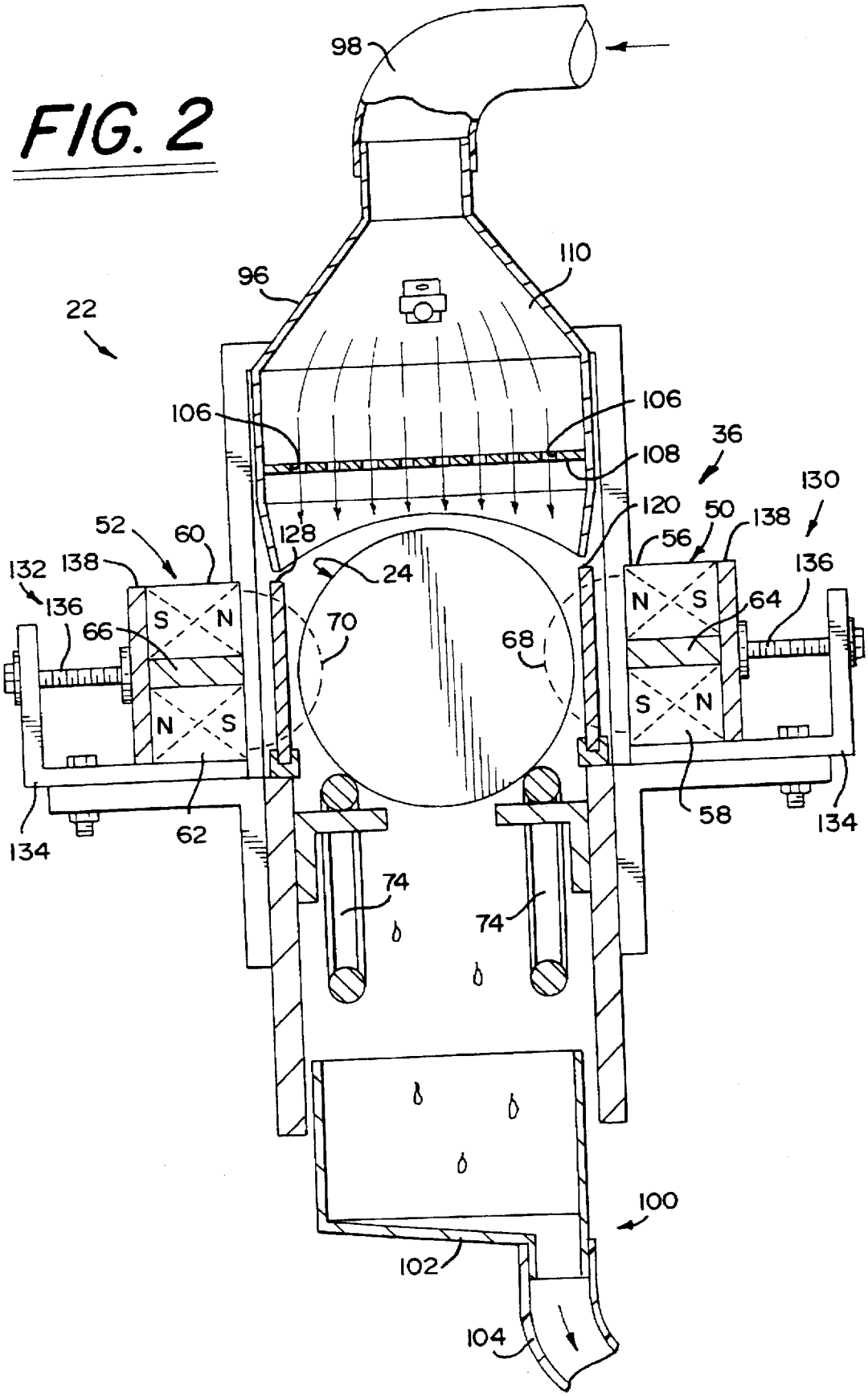
FIG. 2 is an enlarged, partial fragmentary, cross-sectional, side-elevational view of the separating and drying station as taken along line 2—2 in FIG. 1.
Figure 3:
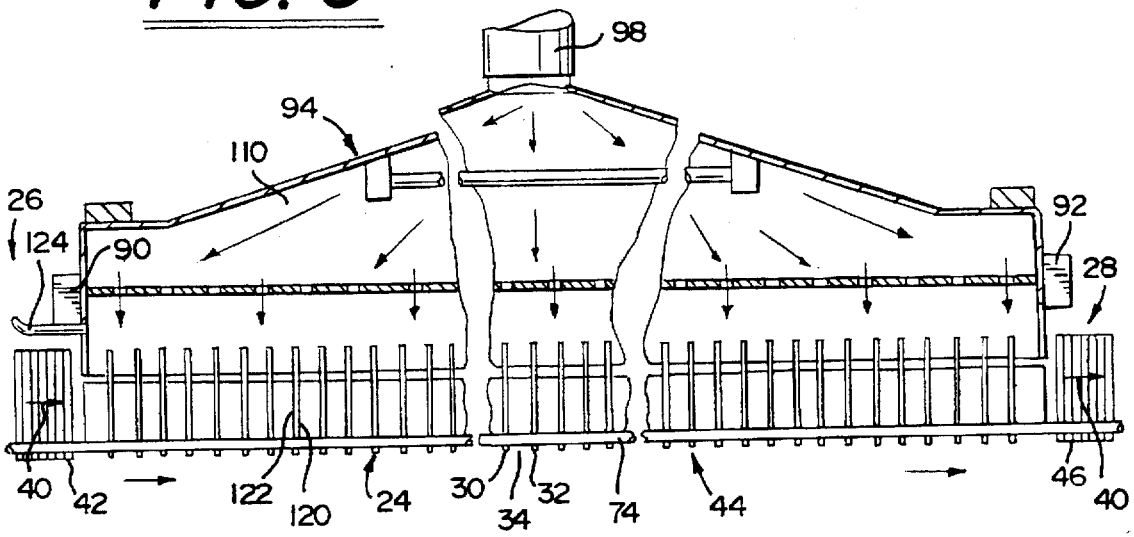
FIG. 3 is an enlarged, partial fragmentary, cross-sectional, side-elevational view taken along the line 3—3 in FIG. 1 showing a cross-section view generally perpendicular to that as shown in FIG. 2 showing air direction apertures in a air plenum of the separating and drying station.
Figure 4:
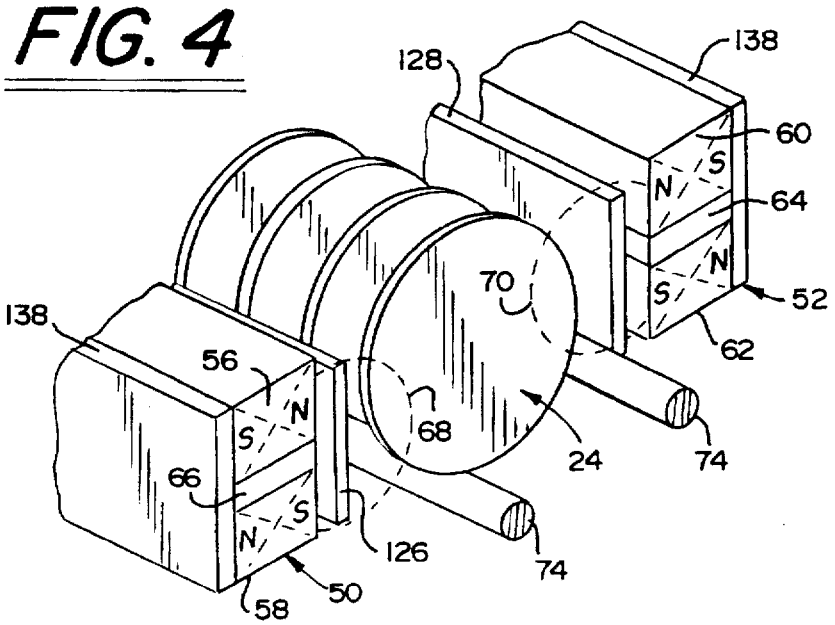
FIG. 4 is an enlarge, partial fragmentary, perspective view presented in a diagrammatic form of a group of separated articles moving through the separating and drying station in the position of the magnetic bodies and the magnetic flux resulting from the magnetic bodies.

With further reference to FIGS. 2–4, the magnetic assembly 36 includes a pair of elongated magnetic bodies 50, 52 positioned opposite one another on opposite sides of the container ends. Both magnetic bodies 50, 52 include a first and a second magnetic element 56, 58 and 60, 62 respectively. A nonmagnetic filler 64, 66 is provided between each pair of upper and lower magnetic elements 56, 58 and 60, 62, respectively. It should be noted that the filler 64, 66 may be a nonmagnetic material as well as an air gap. Shown herein a nonmagnetic material such as plastic is employed to maintain the space between the first and second magnetic elements.

The magnetic elements 56, 58, 60, 62 of each magnetic body 50, 52 are arranged on opposite side of the container ends to provide a magnetic field 68, 70 influencing the orientation of the container ends passing therethrough. By maintaining a constant magnetic field effect on the container ends, the container ends are prevented from failing over or toppling as they are separated and pass through the separating and drying station 22. The poles of the magnetic elements 56, 58, 60, 62 are arranged so that the first magnetic elements 56, 60 have a north pole position in opposition to a south pole of the corresponding second magnetic elements 58, 62, respectively. As such, the magnetic bodies 50, 52 create magnetic fields 68, 70, represented diagrammatically by the dashed lines shown in FIGS. 2 and 4.

The magnetic bodies 50, 52 are positioned with the corresponding first elements 56, 60 and second elements 58, 62 having a mirror orientation. As illustrated, both the first elements 56, 60 have a north pole and the second elements 58, 62 have a south pole facing the edges of the container ends 24 passing therebetween. As such, the magnetic bodies 50, 52 provide a magnetic influence on the opposite sides of the container ends to retain them in a generally vertically-oriented, upright, on-end position. Further, as can be seen in FIG. 4, the magnetic effect of the magnetic fields 68, 70 causes neighboring ends 30, 32 to be similarly magnetized resulting in the neighboring ends 30, 32 repelling one another. A generally parallel gap results between the neighboring container ends 30, 32 as a result of the repulsion forces. As can be seen, the separated stream 44 generally equally spaces container ends throughout the separating and drying station 22.

Having now generally described the effect of the magnetic separating assembly 36 on the container ends 24 passing through the separating and drying station 22, we turn to the general structure of the separating and drying station 22 and a conveying device 72 which transports the ends through the separated stream 44. The conveying device 72 includes a pair of spaced apart non-magnetic conveyor belts 74 extending through the separating and drying station 22 parallel to the path of travel 40. The belts 74 are retained at an entry end around a pulley assembly 76 and around a similar pulley assembly 78 at the outfeed end. A first variable speed motor 80 drives the outfeed pulley 78 by way of the first drive belt 82. The variable speed motor 80 is controlled by a controller 84 which will be described in greater detail hereinbelow. A second outfeed conveyor 86 includes at least a powered driving unit for controllably driving container ends from the outfeed station 28. The outfeed conveyor 86 is driven by a second variable speed motor 88, also coupled to the controller 84. As such, the belts 74 are driven by the first variable speed motor 80 to move the separated stream 44 through the separating and drying station 22. Additionally, the outfeed conveyor 86 provides controlled, powered movement of the outfeed stream of articles 46 through the ouffeed station 28.

An infeed sensor 90 and an outfeed sensor 92 are positioned near the interface between the infeed station 26 and the separating and drying station 22 and the interface between the outfeed station 28 and the separating and drying station 22, respectively. The infeed sensor 90 senses the movement of articles from the infeed stream 42 to the separated stream 44. Similarly, the ouffeed sensor 92 senses the movement of articles from the separating stream 44 to the outfeed stream 46. The infeed and outfeed sensors 90, 92 are coupled to the controller 84 to sense the movement of articles through the separating and drying system. As mentioned above, the first and second motors 80, 88 are also coupled to the controller 84. In this manner, the controller 84 can regulate the speed of the belts 74 and the conveyor 86 by controlling the variable speed motors 80, 88. Further, the dwell time of the articles passing through the separating and drying station 22 can be regulated by controlling the motors 80, 88 by way of the controller 84.

Turning now to the air distribution assembly 38 as briefly described hereinabove, it can be seen that the air distribution assembly 38 includes an air plenum 94 which is connected to an air blower fan or air driving device 96 by way of an air hose 98. As shown in FIG. 1, air is moved from the driving device 96 through the hose 98 to the plenum 94. The air is then distributed by the plenum 94 over the entire length of the drying and separating station 22. As such, air is passed through the gaps 34 between the articles traveling and the separated stream 44.

With reference to FIG. 2, air passing from the air plenum 94 and over a surface of an article 24 is directed downwardly through the spaced-apart conveyor belt 74 and into a receiving plenum 100. The receiving plenum 100 includes a moisture collection structure 102 to capture any moisture which precipitates out of the air exhausted from between the gaps 34. Any moisture which collects in the collection structure 102 is drained therefrom through a drain hose 104.

FIG. 3 provides a partial fragmentary, cross-sectional, side-elevational view of the plenum 94 to show a plurality of outlet apertures, generally identified by reference numeral 106, which are formed in the face 108 of the plenum 94. As shown in FIG. 3, the hose 98 is connected to a top portion of the plenum. Air entering the plenum 94 is distributed through a cavity 110. The positive pressure by the air entering from the hose 98 drives the air in the chamber 110 through the aperture 106.

Guide bars 124 are provided at an entry end of the separating and drying station 22. The guide bars 124 help to assure that the container ends will not be caught on the air plenum 94 as they enter the area underneath the air plenum 94. As container ends 24 are pulled into the infeed stream 42 by the action of the conveyor belts 74 and magnetic assembly 36 they may tend to move upwardly. As such, the guide bar 24 helps to maintain the container ends in the path of travel and prevents these ends from being caught on the air plenum 94.

Guide panels 126, 128 are also provided along the length of the separating and drying station 22 to help contain the container ends 24 in the separated path 44. The guides 126, 128 are positioned on either side of the conveyor belts 74.

It should also be noted that the magnetic bodies 50, 52 are retained on adjustment devices 130, 132. The adjustment devices 130, 132 include a positioning bracket 134 and an adjustable screw assembly 136. The screw assembly 136 is attached to a mounting structure 138 of the magnetic bodies 50, 52. As such, the adjustment screw assemblies 136, 136 can be adjusted inwardly or outwardly relative to the separated stream of articles 44 to adjust and control the magnetic fields 68, 70 imposed on the articles 24.

In use, the method of the present invention includes feeding articles from an endfeed station 26 to the separating and drying station 22. Articles passing through the separating and drying station 22 are moved therefrom to an outfeed station 28. In the separating and drying station 22, the container ends are magnetically separated by the magnetic separation assembly 36 as described hereinabove. The articles then are subjected to air flow passing through the gaps 34 created between neighboring articles 30, 32 by the magnetic separation assembly 36. The air flow removes moisture from the materials applied to at least one of the surfaces of the articles in order to further dry or cure the material such as a compound finer. The articles are conveyed through the separating and drying station 22 by means of a conveyor belt 74 positively engaging edge portions of the container ends 24. The air is removed from the below the separated stream 44 whereupon moisture may collect in the collection station 102 and drained through the drain tube 104. The motors 80, 88 which drive the conveyor belts 74 and the outfeed conveyor 86 are coupled to the controller 84 to control the speed at which the articles in the separated stream 44 move through the separating and drying station 22 and, accordingly, the dwell time during which the container ends are exposed to the air flow from the air distribution assembly 38.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. An article separating and drying system which receives a plurality of articles, separates said articles, and passes air between neighboring ones of said separated articles, said system including an infeed station, an outfeed station, and a separating and drying station positioned between said infeed station and said outfeed station, said system comprising:

a generally linear, axially elongated conveying device positioned in at least said separating and drying station for conveying said separated articles through said separating and drying station;

a magnetic separation assembly positioned in at least said separating and drying station for inducing a magnetic flux on opposite sides of said articles moving therethrough to cause neighboring ones of said articles to be similarly magnetized thereby repelling each other and producing a generally parallel gap therebetween;

an air distribution assembly positioned in said separating and drying station for moving air across said articles in said separating and drying station to pass air through said gaps between neighboring ones of said articles in order to facilitate drying of a substance on at least a portion of said articles.

2. A separating and drying system as recited in claim 1, said conveying device further comprising:

a dual belt conveyor having two spaced-apart nonmagnetic belts extending through said separating and drying station for actively driving articles positioned thereon through said separating and drying station.

3. An article separating and drying system as recited in claim 1, said system further comprising:

said separating and drying station being generally elongated;

said magnetic separation assembly including two, spaced-apart, elongated magnetic bodies generally parallel to the elongation of said separating and drying station, said articles being moved between said magnetic bodies to produce a magnetic influence on said articles.

4. An article separating and drying system as recited in claim 3, further comprising:

adjustment devices attached to said magnetic bodies for adjusting said magnetic bodies relative to said articles, said magnetic bodies being adjusted relative to said path of travel of articles for imposing a desired magnetic field strength on said articles.

5. A separating and drying system as recited in claim 3, each of said magnetic bodies further comprising a first magnetic element and a second magnetic element, said first and second magnetic elements arranged in each of said magnetic bodies with opposing north-south magnetic polarities to produce a magnetic flux relative to each side of said articles passing through said separating and drying station; and said first magnetic element in each of said magnetic bodies having reverse north-south magnetic polarity, and said second magnetic elements in both of said magnetic bodies having reverse north-south magnetic polarities.

6. A separating and drying system as recited in claim 5, said magnetic separating assembly further comprising:

said first and second magnetic elements being separated by a nonmagnetic element in order to produce a desired magnetic flux between said first and second magnetic elements.

7. An article separating and drying system as recited in claim 1, said air distribution assembly further comprising an air drying device coupled to an air plenum for driving air into said plenum, said plenum having at least one outlet aperture for directing air toward said articles in order to move air through said gap between neighboring ones of said articles positioned in said separating and drying station.

8. An article separating and drying system as recited in claim 7, wherein said air plenum is positioned above said articles and said magnetic separating assembly includes a pair of spaced-apart magnetic bodies positioned along sides of said articles moving through said separating and drying station, said air being forced from said air plenum through said gaps between neighboring ones of said articles being at least partially retained from escape from said separating and drying station by said magnetic bodies positioned on either side of said articles moving through said separating and drying station.

9. A separating and drying system as recited in claim 7, said air distribution assembly further comprising a moisture collection structure being positioned generally opposite said air plenum for capturing moisture from air being passed through said gap, whereby said moisture in said air being moisture-removed from said articles passing through said separating and drying station.

10. An article separating and drying system as recited in claim 1, said conveying device further comprising an infeed conveyer and an outfeed conveyer, said infeed conveyer positively driving said articles through said infeed station to said separating and drying station and Said outfeed conveyer positively driving said articles from said separating and drying station through said outfeed station.

11. An article separating and drying system as recited in claim 10, said conveying device further including a drying stage conveyer for positively driving said articles through said separating and drying station.

12. An article separating and drying system as recited in claim 10, said conveying device further comprising:

a sensor assembly for sensing the speed of said articles moving through said separating and drying system, said sensor assembly including an infeed sensor positioned approximate to said infeed station, an outfeed sensor positioned approximate to said outfeed station, and a controller coupled to said infeed and outfeed sensors and to said infeed and outfeed conveyers to control the rate at which said articles move through said separating and drying station.

13. An article separating and drying system as recited in claim 10, said conveying device including a pair of spaced-apart conveyor belts contacting corresponding surfaces of said articles for moving said articles thereby, air from said air distribution assembly contacting said articles, and passing through said gaps between neighboring ones of said articles, said air passing between said articles passing through said spaced-apart conveyor belts for promotion efficient flow of air through said separating and drying station.

14. A method for drying a plurality of articles moving along axially oriented generally linear path of travel, said method comprising the steps of:

providing an infeed stream of articles;

imposing a magnetic field on said generally opposite sides of articles to similarly magnetize said articles to produce repelling forces between neighboring ones of said articles to produce a generally parallel gap between said neighboring ones of said articles;

moving said separated articles along said path of travel in a stream of separated articles; and driving air against said separated stream of articles to drive air through said gaps between neighboring ones of said articles for removing moisture from said articles.

15. A method as recited in claim 14, further comprising the steps of:

collecting moisture from air passing through said gaps between neighboring ones of said articles for draining said moisture away from said drying and separating system.

16. An article separating and drying system comprising:

an article separating and drying station for separating a plurality of articles moving along a axially elongated and generally linear path of travel and passing air through gaps between neighboring ones of said plurality of articles;

conveyor for moving said articles through said separating and drying station;

pair of spaced-apart magnetic bodies positioned on opposite sides of said plurality for producing a magnetic effect on said articles causing neighboring ones of said articles to repel one another thereby producing a gap between said neighboring ones of said articles;

an air distribution assembly, said air distribution assembly driving air against said articles positioned in said separating and drying station between said magnetic bodies to force air through said gaps between neighboring ones of said articles to remove moisture from said articles.

* * * * *

UNITED STATES PATENT AND TRADEMARK OFFICE

CERTIFICATE OF CORRECTION

PATENT NO. : 5 ,669,156
DATED : September 23, 1997
INVENTOR(S) : Miroslav W. Vejchoda It is certified that error appears in the above-identified patent and that said Letters Patent is hereby corrected as shown below:

Title page item [56], under References Cited, add--

| | | | | |
|---|---|---|---|---|
| 3824516 | 7/1974 | BENOWITZ | 198 | 619 |
| 3840999 | 10/1974 | WHELAN | 34 | 105 |
| 4052152 | 10/1977 | WHELAN ET AL. | 34 | 105 |
| 4113142 | 9/1978 | RYZHOV ET AL. | 198 | 381 |
| 5501317 | 3/1996 | SOMMER ET AL. | | |

Signed and Sealed this

Seventeenth Day of March, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5 ,669,156

DATED : September 23, 1997

INVENTOR(S) : Miroslav W. Vejchoda

It is certified that error appears in the above-identified patent and that said Letters Patent is hereby corrected as shown below:

Title page item [56], under References Cited, add--

| | | | | |
|---|---|---|---|---|
| 3824516 | 7/1974 | BENOWITZ | 198 | 619 |
| 3840999 | 10/1974 | WHELAN | 34 | 105 |
| 4052152 | 10/1977 | WHELAN ET AL. | 34 | 105 |
| 4113142 | 9/1978 | RYZHOV ET AL. | 198 | 381 |
| 5501317 | 3/1996 | SOMMER ET AL. | | |

UNITED STATES PATENT AND TRADEMARK OFFICE

CERTIFICATE OF CORRECTION

PATENT NO. : 5,669,156

DATED : September 23, 1997

INVENTOR(S) : Miroslav W. Vejchoda

It is certified that error appears in the above-indentified patent and that said Letters Patent is hereby corrected as shown below:

Column 1 Line 1 please insert -- The present invention relates to the manufacture of metal articles and more particularly to the handling of articles to which a material is applied. and the drying of the material on such articles. Specifically, the present invention relates to conveying and drying systems for handling container ends. --

Column 2, Line 8 "carded" should be --carried --

Column 4, Line 39 "failing" should be --falling --

Column 5, Line 29 "ouffed" should be --outfeed --

Column 6, Line 36 "finer" should be --liner--

This certificate supercedes Certificate of Correction issued March 17, 1998.

Signed and Sealed this

Fourteenth Day of July, 1998

Bruce Lehman

*Attest:*

BRUCE LEHMAN

*Attesting Officer*

*Commissioner of Patents and Trademarks*